United States Patent [19]

Simpson

[11] 4,063,808

[45] Dec. 20, 1977

[54] APPARATUS FOR NEUTRALIZING TONER IN A NO CHARGE EXCHANGE TRANSFER

[75] Inventor: Henry Wellington Simpson, Boulder, Colo.

[73] Assignee: International Business Machines Corporation, Armonk, N.Y.

[21] Appl. No.: 669,545

[22] Filed: Mar. 23, 1976

[51] Int. Cl.[2] ..... G03G 15/16
[52] U.S. Cl. ..... 355/3 TR
[58] Field of Search ..... 355/3 TR, 3 R; 96/1.4

[56] References Cited

U.S. PATENT DOCUMENTS

| | | | |
|---|---|---|---|
| 3,762,811 | 10/1973 | Matsumoto | 355/3 R |
| 3,832,053 | 8/1974 | Goel et al. | 355/3 TR |
| 3,837,741 | 9/1974 | Spencer | 355/3 TR |
| 3,992,557 | 11/1976 | Kubo et al. | 96/1.4 |

OTHER PUBLICATIONS

Simpson; "Transfer Device"; IBM Tech. Discl. Bull.; vol. 16, No. 4, p. 1271; Sept. 1973.

*Primary Examiner*—A. D. Pellinen
*Attorney, Agent, or Firm*—Homer L. Knearl; Earl C. Hancock

[57] ABSTRACT

In a no-charge-exchange transfer, the transfer sheet leaving a no-charge-exchange transfer roller contains little or no electrical charge except for the charged toner. Accordingly, the charged toner tends to explode off the sheet or migrate on the sheet due to like charge on the toner causing toner particles to repel each other. A neutralizing corona is provided adjacent the image side of the copy sheet. This corona is positioned after the nip of the transfer roller and before the copy sheet leaves the transfer roller. Ions emitted from the neutralizing corona reduce the charge on the toner particles to substantially zero. Thus, the toner particles no longer repel. Forces of adhesion hold the particles to the paper after the sheet leaves the transfer roller and proceeds to the fusing station.

11 Claims, 2 Drawing Figures

APPARATUS FOR NEUTRALIZING TONER IN A NO CHARGE EXCHANGE TRANSFER

BACKGROUND OF THE INVENTION

1. Field of the Invention

This invention relates to a no-charge-exchange transfer stations in a xerographic copying machine. More particularly, this invention relates to neutralizing toner particles as a part of the no-charge-exchange transfer process.

2. Review of Prior Art

Transfer stations in the xerographic process typically employ a transfer corona, a charge-exchange transfer roller or a no-charge-exchange transfer roller. Transfer coronas are placed on the side of the paper opposite from the toner. The corona charges the paper and charge on the paper causes the toner to transfer from a photoconductor to the paper. Neutralizing coronas to partially neutralize the paper are known in transfer corona stations. With transfer coronas the problem is that by charging the paper to accomplish the transfer the paper is also tacked to the photoconductor. To aid separation of the paper or sheet from the photoconductor a neutralizing corona is used to partially discharge the paper after the transfer of toner and just prior to separation of the paper from the photoconductor. Charge-exchange transfer rollers operate in substantially the same manner as transfer coronas.

The problem solved by this invention occurs in no-charge-exchange (NCX) transfer rollers. In NCX transfer rollers the toner is transferred without charging the paper or sheet to which the toner is transferred. One description of this process appears in commonly assigned U.S. Pat. No. 3,879,121. The problem arises in that since the copy paper or transfer sheet is uncharged the only forces holding the toner on the sheet after the sheet leaves the transfer roller are the forces of adhesion. While the sheet is on the transfer roller the electric field from the roller assists in holding the toner particles on the roller. After the sheet leaves the roller the only substantial charges present on the sheet are the charges on the toner particles. Thus, the electrical forces on the toner particles causing the particles to repel each other can overcome the adhesion forces holding the toner in place. The toner tends to blow off the copy sheet or to move on the surface of the copy sheet.

One prior art solution to this problem is post-nip ionization as discussed in U.S. Pat. No. 3,781,105, issued to Thomas Meagher. The Meagher patent teaches a no-charge-exchange transfer roller with an electric field that increases from a pre-nip region to a post-nip region. Transfer is accomplished in the area of the nip between the transfer roller and the photoconductor. The electric field in the post-nip region is high enough to ionize the air between the transfer roller and the back (side opposite from toner) of the transfer sheet. Thus, the Meagher apparatus deposits charge on the back of the paper or transfer sheet as the sheet leaves the photoconductor. This charge on the transfer sheet holds the toner on the transfer sheet after the transfer. The difficulty with the Meagher apparatus is that it is very difficult to manufacture transfer rollers that will have the desired electric field characteristic that Meagher calls for. Further, the Meagher apparatus is very sensitive to atmospheric conditions such as pressure and humidity.

To review, Meagher charges the back side of the paper as it is leaving the transfer roller so as to help the paper retain the toner particles. The difficulty with this approach is that atmospheric conditions may affect the quality of the charge on the paper and may also cause charges to migrate to the photoconductor thus defeating the no-charge-exchange transfer process.

SUMMARY OF THE INVENTION

In accordance with this invention the above problem is solved by wrapping the transfer sheet about the transfer roller so that the transfer sheet leaves the photoconductor region and subsequently leaves the transfer roller. Further, a toner neutralizing corona is mounted on the toner side of the transfer sheet after the sheet has left the photoconductor and before the sheet leaves the transfer roller. Thus, the transfer roller holds the toner particles on the transfer sheet until the toner particles pass under the neutralizing corona. The toner neutralizing corona substantially discharges the toner particles. Therefore, when the transfer sheet leaves the transfer roller the toner particles are stabilized on the transfer sheet. The toner particles do not repel each other and are held in position on the transfer roller by adhesion.

As a further feature of the invention, charge, that may be placed on the surface of the transfer roller due to the toner neutralizing corona or other effects, is removed before the surface of the transfer roller again enters the nip region.

The great advantage of the invention is that no-charge-exchange transfer is accomplished relative to the photoconductor with little or no risk that the charge used to neutralize the toner will reach the photoconductor. Changes in atmospheric conditions such as pressure or humidity have little or no effect on this apparatus. Further the no-charge-exchange transfer roller is of conventional design and relatively easy and cheap to manufacture. No special considerations need be given to the transfer roller with regard to solving the problem of holding toner on the transfer sheet after it leaves the transfer roller.

The foregoing and other features and advantages of the invention will be apparent from the following more particular description of preferred embodiments of the invention as illustrated in the accompanying drawings.

DETAILED DESCRIPTION

Figure 1:
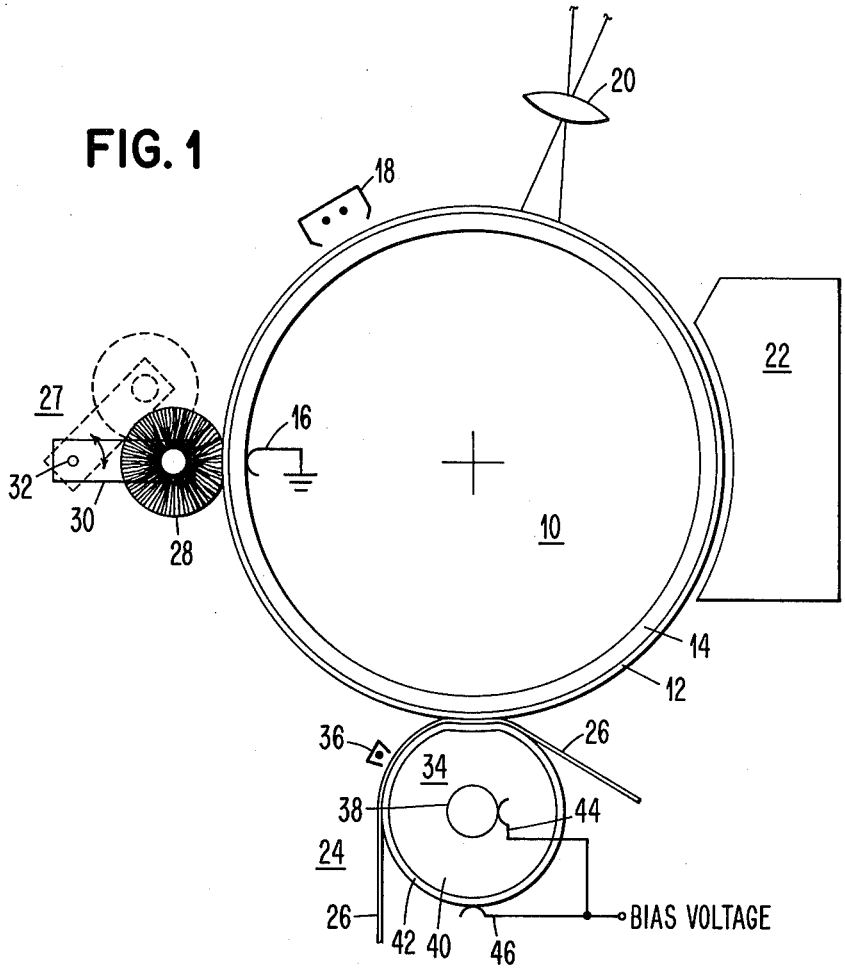
FIG. 1 is a schematic representation of a xerographic system with one preferred embodiment of the inventive no-charge-exchange transfer station.

In FIG. 1 the well-known process stations of a xerographic process are shown positioned around a photoconductor drum 10. Photoconductor drum 10 is formed by placing a photoconductive layer 12 on a conductive cylinder 14. Conductive cylinder 14 is grounded by conductive wiper 16.

As is well known the xerographic process steps include charging the photoconductor, exposing the photoconductor to the image to be copied, developing the electrostatic image, transferring toner particles from the photoconductor to the transfer web or copy sheet and cleaning the photoconductor in preparation for the next copying cycle. In FIG. 1, corotron 18 represents the charging station while lens 20 represents the imaging station. Corotron 18 places a relatively uniform charge on the surface of photoconductor 12. Lens 20 exposes the photoconductor to the image to be copied. Light areas of the image discharge the photoconductor more than dark areas of the image. Thus, the photoconductor as it leaves the imaging station 20 carries an electrostatic image of the original.

This electrostatic image is developed by developer station 22. Developer 22 deposits on the photoconductor toner particles charged oppositely to the electrostatic image on the photoconductor 12. Accordingly, as the image leaves the developer 22, dark areas of the image carry toner while light or white areas of the image carry substantially no toner. The developed electrostatic image then passes through a no-charge-exchange (NCX) transfer station 24.

At NCX transfer station 24 toner particles are transferred from the photoconductor to the copy sheet or web 26. No-charge-exchange transfer accomplishes the transfer of toner while substantially preventing the discharge of the electrostatic image on the photoconductor 12. When photoconductor 12 leaves transfer station 24 the electrostatic image on the photoconductor is intact.

Cleaning station 27 is represented by a brush 28 mounted on a arm 30 which will pivot about point 32. In a xerographic process using no-charge-exchange transfer it is possible to deactivate the cleaning station 27, the charging corona 18 and imaging station 20 to develop and transfer more than one toner image from the same electrostatic image on the photoconductor 12. Therefore, cleaning station 26 is schematically represented as being pivotally mounted so as to disengage from the photoconductor surface. When cleaning is desired, brush 28 is in contact with the photoconductive surface to clean off toner from the photoconductive surface as is well known in the art. Coronas and/or lights may be used in conjunction with the brush at the cleaning station to clean toner from the photoconductor surface.

While the xerographic process has been described for background, the transfer station 24 is the area of applicant's invention. In the NCX transfer operation of FIG. 1 copy sheet 26 is guided into contact with the photoconductor 12 by transfer roller 34. Toner particles transferred to the copy sheet 26 are held on the copy sheet by two forces — mechanical adhesion of the particle to the sheet and electrical attraction of the charged toner particles to the oppositely charged NCX transfer roller 34. Accordingly, charged particles on the copy sheet 26 would only be held by adhesive forces after the copy sheet leaves the transfer roller 34. These forces of adhesion are not sufficient to overcome the electrical field forces between the toner particles all of which are charged to the same polarity. Accordingly, if the copy sheet 26 leaves the NCX transfer roller 34 with charged toner particles, the particles explode off the copy sheet 26.

To prevent the toner particles from blowing each other off copy sheet 26, neutralizing corotron 36 sprays the toner particles with ions of opposite polarity to the charge on the toner particles. The toner neutralizing corotron 36 is positioned on the toner side of the copy sheet 26. Further it is positioned after the toner particles have left the nip between the transfer roller and the photoconductor and before the toner particles leave the transfer roller. Finally the neutralizing corona is positioned so that it will not affect the electrostatic image on the photoconductor 12.

As the charged toner particles pass under the neutralizing corona 36 they are substantially discharged. With the toner particles being discharged before they leave the effective field of the NCX transfer roller, the adhesive forces between the toner particles and the copy sheet are sufficient to hold the toner particles on the copy sheet until the copy sheet reaches a fusing station.

As shown in FIG. 1 the no-charge-exchange transfer is accomplished by a resilient transfer roller 34. Transfer roller 34 holds the copy sheet 26 in contact with the photoconductor 12 as the copy sheet passes through the nip between roller 34 and photoconductor 12. The roller 34 consists of conductive metal hub 38 surrounded by a resilient conductive rubber layer 40 surrounded by a thin flexible dielectric layer 42. Shaft 38 is a rigid conductive metal to which the bias potential for the transfer roller is applied by wiper 44. The conductive rubber layer 40 has a resistivity in the range of $10^5$ or less ohm-cm. The conductive rubber layer conducts charge from the conductive shaft 38 to the boundary between the conductive rubber layer 38 and the dielectric layer 42. The thin flexible dielectric layer has a resistivity greater than $10^{14}$ ohm-cm and serves to prevent electrical charge in the conductive rubber layer of the transfer roller from reaching the copy sheet 26 or the photoconductor 12.

The outer surface of the dielectric layer 42 due to its proximity to the photoconductor 12 and the neutralizing corona 36 will typically pick up charge which could inhibit the transfer function. Accordingly, wiper 46 conducts charge on the surface of the dielectric away from the dielectric to the bias voltage.

Figure 2:
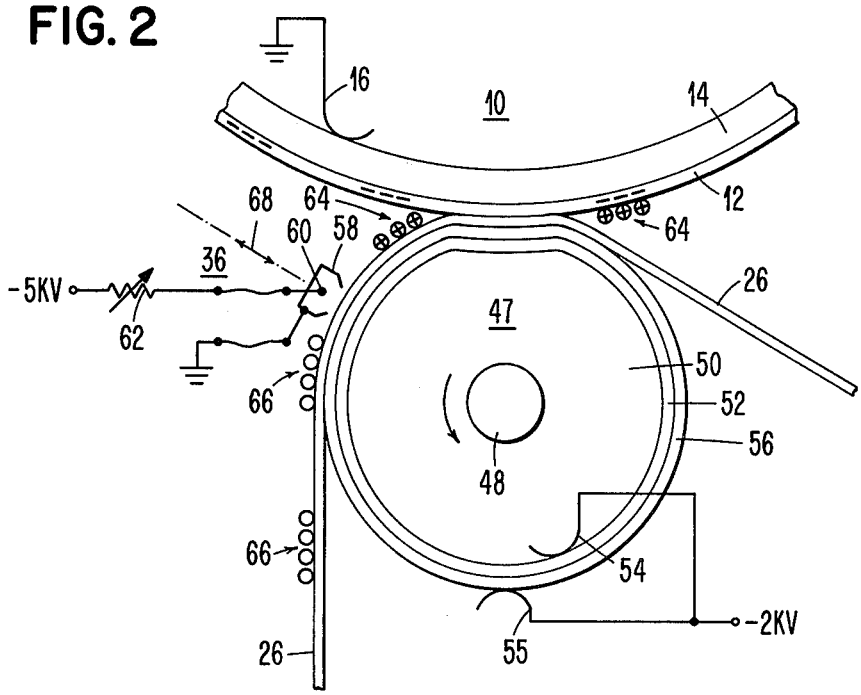
FIG. 2 is an enlarged view of another preferred embodiment of the no-charge-exchange transfer station.

The operation of the invention is more clearly shown in FIG. 2 which is an enlarged view of the transfer station of FIG. 1. Photoconductor 12 is carried by cylindrical conductive drum 14 which is grounded through wiper 16. In addition FIG. 2 uses a slightly different transfer roller than the transfer roller of FIG. 1. The no-charge-exchange transfer roller of FIG. 2 is made up of a rigid shaft 48 which may be conductive or non-conductive. Attached to the shaft 48 is a relatively thick resilient layer 50 which might be nonconductive rubber. The next layer of transfer roller 47 is a thin flexible conductive film 52. The thin conductive film 52 is preferably an aluminum layer formed by vacuum deposition. Electrical contact for biasing NCX transfer roller 47 is made to the conductive layer 52 by a wiper 54. The biased conductive layer 52 is separated from the copy sheet 26 by a thin flexible dielectric layer 56. The dielectric layer prevents charge from migrating from the transfer roller to the copy sheet 26 or the photoconductor 12.

Wiper 55 is provided to discharge the surface of dielectric layer 56 prior to the surface re-entering the nip region. Wiper 55 is biased to the same voltage as conductive layer 52. Therefore there is no electrical field through dielectric layer 56 at the wiper 55, and any charge present on the surface of layer 56 will be conducted away by wiper 55.

The toner neutralizing corotron 36 has a shield 58 connected to ground and a single corona wire 60 connected to a large voltage through potentiometer 62. Alternatively, shield 58 can be connected to some potential, but there must be sufficient potential difference between shield 58 and corona wire 60 to produce ionization. Potentiometer 62 acts to control the current supplied to corotron 36. As will be discussed hereinafter potentiometer 62 and the separation of corona wire 60 from the copy sheet 26 are used to control the current flow to the copy sheet to neutralize the toner.

In the example of FIG. 2 a negatively charged electrostatic image exists on the photoconductor 12. Accordingly, toner particles are positively charged and the bias voltage on the transfer roller 47 and the voltage supplied to the toner neutralizing corotron 36 are negative voltages. Of course, if the electrostatic image on the photoconductor 12 were positive and the toner particles negatively charged than the bias to the transfer roller 47 and the voltage applied to the corotron 36 would be positive in polarity.

The operation of the preferred embodiment of the invention in FIG. 2 is depicted by the charge patterns on the photoconductor 12, the charge on the toner particles 64, followed by the lack of charge on toner particles 66 exiting the position of the toner neutralizing corotron 36. As the photconductor 12 moves into the nip of the NCX transfer roller 47, it carrier positively charged toner particles 64. Voltage levels on the surface of the photoconductor are in the order of −800 volts for dark areas and −150 volts for light areas. The bias applied to conductive layer 52 of NCX transfer roller 47 is −2000 volts. Accordingly, the electric field lines will flow from the photoconductor to the flexible conductive layer 52. Positively charged toner particles 64 are transferred from the photoconductor surface 12 to the copy sheet 26. This is depicted by the charged toner particles 64 on copy sheet 26 leaving the region of nip between roller 47 and photoconductor drum 10.

So long as the copy sheet 26 remains on the transfer roller the bias applied to flexible conductive layer 52 is sufficient to hold the positively charged toner particles on the copy sheet 26. However, if the toner particles are still positively charged when copy sheet 26 leaves the transfer roller, electrical forces of repulsion between toner particles are greater than forces of adhesion holding the toner particles on the copy sheet 26. In the copy sheet left the no-charge-exchange transfer roller with charged toner particles, the particles would either blow off the copy sheet or migrate on the copy sheet.

Corotron 36, in FIG. 2, emits negative ions from its corona wire 60. These negative ions are sprayed by corotron 36 onto the copy sheet 26 and the toner particles as the copy sheet passes under the corotron 36. The negatively charged ions discharge the positively charged toner particles. As indicated in FIG. 2, the toner particles 66 leaving the corotron 36 carry substantially no charge. Therefore, the forces of adhesion between the toner particles and between the toner particles and the copy sheet 26 are sufficient to hold the toner on the copy sheet. As is well known the copy sheet is then passed to a fusing station to permanently bond the toner particles to the copy sheet.

The current flow from the corotron 36 to the copy sheet should be adjusted to a level such that the toner particles are neutralized. If there is too little current flow from the corotron to the copy sheet, the toner particles will not be neutralized. If the flow of current is too great the toner particles can become oppositely charged or negatively charged in the example of FIG. 2. If the toner particles do become negatively charged the same problem of toner particles repelling each other and blowing off the copy sheet will exist. Therefore, it is necessary that the corotron 36 be adjusted to achieve the proper current flow to the copy sheet 26.

In the preferred embodiment a −5000 volt source is connected to the corona wire 60 through potentiometer 62. Current flow to the copy sheet 26 may then be adjusted by adjusting the resistance of potentiometer 62 and/or by adjusting the separation between the corona wire 60 and the copy sheet 26. For the voltages described in the preferred embodiment and for copy sheet moving at 20 ips, it has been found that current flow in the order of 1 microamp per lineal inch of the copy sheet parallel to the corona wire will neutralize the toner particles. In this preferred embodiment this current flow is achieved with a single wire corotron wherein the corona wire is separated from the copy sheet 26 in the order of $\frac{3}{8}$ of an inch to $\frac{1}{2}$ of an inch.

It is not possible to specify a range of operation for the corotron 36 or the current flow to the paper 26. This is due to the fact that current flow to the paper to neutralize the toner particles will depend upon the xerographic process. Particularly, it will depend upon the polarity and magnitude of charge, the magnitude of voltages used in the xerographic process and the speed of the copy sheets. For any given system, corotron 36 can be adjusted to the proper current flow to the copy sheet 26 by adjusting potentiometer 62 and/or by changing the separation between the corotron and the copy sheet as represented schematically by arrow 68. A mechansim to accomplish the adjustment could include mounting corotron 36 on rails parallel to arrow 68. A screw threaded rail could be used to precisely index the corotron separation from the copy sheet. The adjustments should be made such that toner particles are neutralized to substantially no charge. If current flow is too low the toner particles will not be neutralized. If the current flow is too high the toner particles can be charged to opposite polarity. In either event toner particles might repel each other and blow off the copy sheet. A current flow to neutralize the toner particles is what is desired.

It will be apparent to one skilled in the art that other modifications and alterations of the preferred embodiments of the invention may be made without departing from the spirit and scope of the invention. The combination of a toner neutralizing corona with a bias field transfer member has produced the unique result of stabilizing toner particles on a copy sheet as they exit from the transfer station and move to a fusing station. Any apparatus performing the following combination of functions as claimed in each claim falls within the spirit and scope of the present invention.

What is claimed is:

1. Apparatus for stabilizing toner particles on a copy member as the copy member leaves the transfer station in a xerographic process, said apparatus comprising:

transfer means at the transfer station for guiding the copy member into contact with the photoconductor, said transfer means having a bias field to assist the transfer of toner particles when the copy member is in contact with the photoconductor;

said bias field of said transfer means holding toner particles on the copy member after the copy member leaves the region of contact with the photoconductor;

means for neutralizing forces of repulsion between the toner particles on the copy member, said neutralizing means being mounted adjacent the toner image side of the copy member after the copy member has left the region of contact with the photoconductor and before the copy member has left the bias field of said transfer means.

2. The apparatus of claim 1 wherein said neutralizing means comprises:

a corotron having a conductive shield and at least one corona wiere, the opening through the conductive shield being positioned adjacent the toner image side of the copy member;

means for supplying current to the corona wire of said corotron whereby said corotron provides an ion current to the copy member to substantially neutralize charges on toner particles on the copy member.

3. The apparatus of claim 2 and in addition:

means for adjusting the current supplied by said supply means to a level that ion current flowing to said copy member from said corotron produces substantially net zero change on toner particles on the copy member.

4. The apparatus of claim 2 and in addition:

means for adjusting the separation between said corotron and said copy member to a position where the ion current flowing from said corotron to said copy member is at a level to neutralize charges on toner particles on said copy member.

5. Method for neutralizing toner particles on a copy member after toner particles are transferred from a photoconductor to the copy member in the nip region between a no-charge-exhange transfer roller and the photoconductor were the toner particle transfer is in reponse to a bias field emanating from the transfer roller comprising the steps of:

wrapping the copy member on the no-charge-exchange transfer roller for a predetermined distance after the nip region whereby toner particles are held on the copy member by the bias field of the transfer roller;

spraying ions onto the toner particles on the copy member before the copy member unwraps from the transfer roller, said ions being of a polarity opposite to the charge on the toner particles, said spraying of ions providing sufficient charge to neutralize the toner particles before the copy member leaves the region of wrap about the transfer roller.

6. The method of claim 5 and in addition:

adjusting the quantity of ions reaching the toner particles on said copy member during said spraying step whereby said toner particles are neutralized without being significantly undercharged or overcharged.

7. The method of claim 5 and in addition:

discharging the outer surface of said transfer roller after the copy member has unwrapped from the transfer roller so that the transfer roller surface has no charge prior to the surface entering the nip region.

8. In a xerographic copying process having a no-charge-exchange transfer roller with an electric field emanating therefrom for transferring toner particles from a photoconductor to a copy web, the improvement comprising;

means for neutralizing the toner particles to substantially zero net charge;

said neutralizing means being mounted adjacent the toner image side of the copy web after the copy web has left the nip between the transfer roller and the photoconductor and before the copy member has left the influence of the electric field from the transfer roller.

9. The apparatus of claim 8 wherein said neutralizing means comprises:

corona means for generating an ion flow;

shield means for directing the ion flow of said corona means towards said copy web and away from said photoconductor whereby toner particles on said copy web are neutralized without destroying the latent electrostatic image on the photoconductor.

10. The apparatus of claim 9 and in addition:

means for adjusting the ion flow from said corona means to a value sufficient to neutralize toner particles on said copy web so that the toner particles will be substantially free of charge and will not repel each other after leaving the electric field of said transfer roller.

11. The apparatus of claim 8 and in addition:

means for wiping surface charge from the transfer roller after said copy web has left the transfer foller and before the surface of the transfer roller again enters the nip between the transfer roller and the photoconductor.

* * * * *

UNITED STATES PATENT OFFICE

CERTIFICATE OF CORRECTION

Patent No. 4,063,808 Dated December 20, 1977

Inventor(s) Henry Wellington Simpson

It is certified that error appears in the above-identified patent and that said Letters Patent are hereby corrected as shown below:

Column 7, line 2, claim 2, "wiere" should read -- wire --.

Column 7, line 14, claim 3, "change" should read -- charge --.

Column 7, line 26, claim 5, "were" should read -- where --.

Column 8, line 40, claim 11, "foller" should read -- roller --.

Signed and Sealed this

Second Day of May 1978

[SEAL]

Attest:

RUTH C. MASON
Attesting Officer

LUTRELLE F. PARKER
Acting Commissioner of Patents and Trademarks